US006273190B1

(12) United States Patent
Sawyer

(10) Patent No.: US 6,273,190 B1
(45) Date of Patent: Aug. 14, 2001

(54) WELLBORE SIDETRACK PLUG

(76) Inventor: Donald M. Sawyer, 38 La Costa Dr., Montgomery, TX (US) 77356

( * ) Notice: Subject to any disclaimer, the term of this patent is extended or adjusted under 35 U.S.C. 154(b) by 0 days.

(21) Appl. No.: 09/416,980

(22) Filed: Oct. 13, 1999

(51) Int. Cl.[7] ..... E21B 33/12

(52) U.S. Cl. ..... 166/285; 166/117.5; 166/155; 166/185

(58) Field of Search ..... 166/117.5, 285, 166/313, 292, 185, 153, 155, 177.4

(56) References Cited

U.S. PATENT DOCUMENTS

| | | | | |
|---|---|---|---|---|
| 1,715,686 | | 6/1929 | Turner . | |
| 2,014,805 | | 9/1935 | Hinderliter . | |
| 2,043,381 | | 6/1936 | Lane . | |
| 2,058,327 | | 10/1936 | Lane . | |
| 2,119,746 | | 6/1938 | Lane . | |
| 2,281,414 | | 4/1942 | Clark . | |
| 2,509,144 | | 5/1950 | Grable et al. . | |
| 3,116,799 | | 1/1964 | Lemons . | |
| 3,814,187 | * | 6/1974 | Holman | 166/281 |
| 4,133,386 | * | 1/1979 | Knox | 166/285 |
| 4,182,423 | | 1/1980 | Ziebrath et al. . | |
| 4,665,995 | | 5/1987 | Braithwaite et al. . | |
| 5,115,872 | | 5/1992 | Brunet et al. . | |
| 5,195,591 | | 3/1993 | Blount et al. . | |
| 5,222,554 | | 6/1993 | Blount et al. . | |
| 5,246,069 | * | 9/1993 | Glaser et al. | 166/156 |
| 5,392,856 | * | 2/1995 | Broussard et al. | 166/285 |
| 5,431,219 | | 7/1995 | Leising et al. . | |
| 5,474,126 | | 12/1995 | Lynde et al. . | |
| 5,488,989 | | 2/1996 | Leising et al. . | |
| 5,718,288 | * | 2/1998 | Bertet et al. | 166/287 |
| 5,791,416 | * | 8/1998 | White et al. | 166/285 |

FOREIGN PATENT DOCUMENTS

2669461 * 5/1992 (FR) .

* cited by examiner

*Primary Examiner*—David Bagnell
*Assistant Examiner*—Zakiya Walker
(74) *Attorney, Agent, or Firm*—Rosenthal & Osha L.L.P.

(57) ABSTRACT

A plug for a wellbore including a plug element adapted to traverse the wellbore and a reservoir coupled to the plug element. The reservoir is hydraulically coupled to an annular space between a wall of the wellbore and an exterior surface of the plug element. The reservoir carries a filler material within. Extrusion of the filler material from the reservoir causes the filler material to fill the annular space so as to bind the plug element within the wall of the wellbore. One embodiment of the plug an anti-rotation element coupled to the plug element. The plug element can be coupled to drill pipe by opposite-hand thread whereby engagement of the anti-rotation element enables decoupling of the plug from the drill pipe by normal-direction rotation of the drill pipe.

36 Claims, 5 Drawing Sheets

WELLBORE SIDETRACK PLUG

BACKGROUND OF THE INVENTION

1. Field of the Invention

The invention is related generally to the field of drilling wellbores through earth formations. More specifically, the invention is related to devices used to plug back the lower part of a wellbore.

2. Description of the Related Art

It is often desirable, for various reasons, to partially abandon a wellbore which is drilled through certain earth formations. Sometimes partial abandonment is for the purpose of redrill the wellbore through the earth formations along a different path or trajectory. For example, the wellbore operator may wish to test the earth formations at a different position on a geologic structure. In other cases drilling apparatus may have become irretrievably stuck in the lower portion of the wellbore and must be abandoned. When the wellbore operator desires to use a part of the wellbore as originally drilled, rather than abandoning the wellbore entirely, the operator can seal off or "plug" the portion of the wellbore he wishes to abandon, and then can use the unplugged part of the wellbore above the plugged portion to act as a conduit for drilling a new part of the wellbore along a different trajectory. The process of drilling the new part of the wellbore along a different trajectory is known in the art as drilling a "sidetrack", or "sidetracking".

Sidetracking can be performed in a number of different ways, depending on, among other things, whether the remaining (non-abandoned) portion of the wellbore has steel pipe ("casing") installed therein. Methods known in the art for sidetracking include setting a device known as a "whipstock" at the depth in the wellbore where the operator desires to start the sidetrack ("kick-off point"). See U.S. Pat. No. 5,222,554 issued to Blount et al for one example of a whipstock.

Whipstocks are frequently used to start the sidetrack where the wellbore has casing installed. Certain types of whipstocks can be "set" or installed in a cased wellbore in a desired orientation by some form of frictional contact with the casing to prevent rotation. The Blount et al '554 patent shows a typical whipstock having a "setting" mechanism. It is necessary to orient the whipstock rotationally so that the sidetrack will start in the desired azimuthal direction.

Other examples of a whipstock are shown, for example, in U.S. Pat. No. 4,182,423 issued to Ziebarth et al, for use in cases where the wellbore does not have casing. If the sidetrack is initiated from a part of the wellbore which does not include casing (called "open hole"), it is usually desirable to plug the abandoned part of the wellbore by filling it with cement or the like. The whipstock can then be set on the top of the cement after curing, and the sidetrack can be initiated. The whipstock shown in the Ziebarth et al '423 patent includes an adhesive backing and a deformable element to push the adhesive side of the whipstock into contact with the wellbore wall so as to eliminate the need for plugging the open hole.

More recently, it has become common in wellbore drilling to simply fill the abandoned portion of the wellbore with cement and start ("kick off") the sidetrack using directional drilling tools known as "steerable" or "bent housing" motors. These are hydraulically powered drilling motors which have a housing typically subtending an angle of ½degree to 2 degrees along the housing's length (generally about 30 to 40 feet). Such motors are well known in the art for drilling wellbores along a desired trajectory, and to a great extent have replaced whipstocks as a mechanism for starting a sidetrack and drilling a well along a selected trajectory. The steerable or bent housing motor saves the operator time by eliminating an extra "trip" in the wellbore to set and orient the whipstock.

Typically when kicking off a sidetrack using a steerable motor or bent housing motor, the abandoned part of the wellbore is simply filled with cement and the operator waits for the cement to harden before beginning drilling with the steerable motor. In some cases the earth formations at the kick off point are substantially harder than the cement, or the cement may not set to a sufficient compressive strength or may not have uniform hardness over the entire volume of the cement plug. In such cases it may be difficult to start the sidetrack using a bent housing or steerable motor. Soft, or non-uniform cement may be preferentially drilled by the drill bit, and the motor may not be able to "steer" the bit properly to start a sidetrack.

Precast or preformed plugs to start sidetracks are known in the art. U.S. Pat. No. 2,281,414 issued to Clark shows an example of a combined bridge plug and drillable whipstock. U.S. Pat. No. 2,509,144 issued to Grable et al shows a well plugging and whipstock device. U.S. Pat. No. 2,119,746 issued to Lane shows a precast plug-type whipstock used to reestablish verticality of a wellbore which has begun to deviate from vertical. Each of these prior art plugs may require cement to be pumped into the wellbore in a separate step in order to provide sufficient strength to the plug to enable starting a sidetrack, particularly when using steerable or bent housing motors. The additional cementing step can be time consuming, costly, and sometimes ineffective for bonding a precast plug to the wellbore.

SUMMARY OF THE INVENTION

The invention is a sidetrack plug for a wellbore including a plug element adapted to traverse the wellbore and a reservoir coupled to the plug element. The reservoir is also hydraulically coupled to an annular space between a wall of the wellbore and an exterior surface of the plug element. The reservoir carries a filler material within. Extrusion of the filler material from the reservoir by compressing the reservoir causes the filler material to fill the annular space so as to bind the plug element to the wall of the wellbore. One embodiment of the plug includes an anti-rotation element coupled to the plug element. In one embodiment the plug element can be coupled to drill pipe by opposite-handed thread whereby engagement of the anti-rotation element enables decoupling of the drill pipe from the plug by normal-direction rotation of the drill pipe. One embodiment of the reservoir provides for compressing the reservoir by applying downward force on the drill pipe. Another embodiment of the reservoir provides for compressing the reservoir by applying pressure to the drill pipe.

The plug element is preferably made from a material which is at least approximately as hard as the formations in which the sidetrack is to be started. A particular embodiment of the plug element includes flutes and channels which increase the surface area of the outside surface of the plug element to improve the binding between the plug element and the wall of the wellbore by the filler material.

DESCRIPTION OF THE PREFERRED EMBODIMENT

Figure 1:
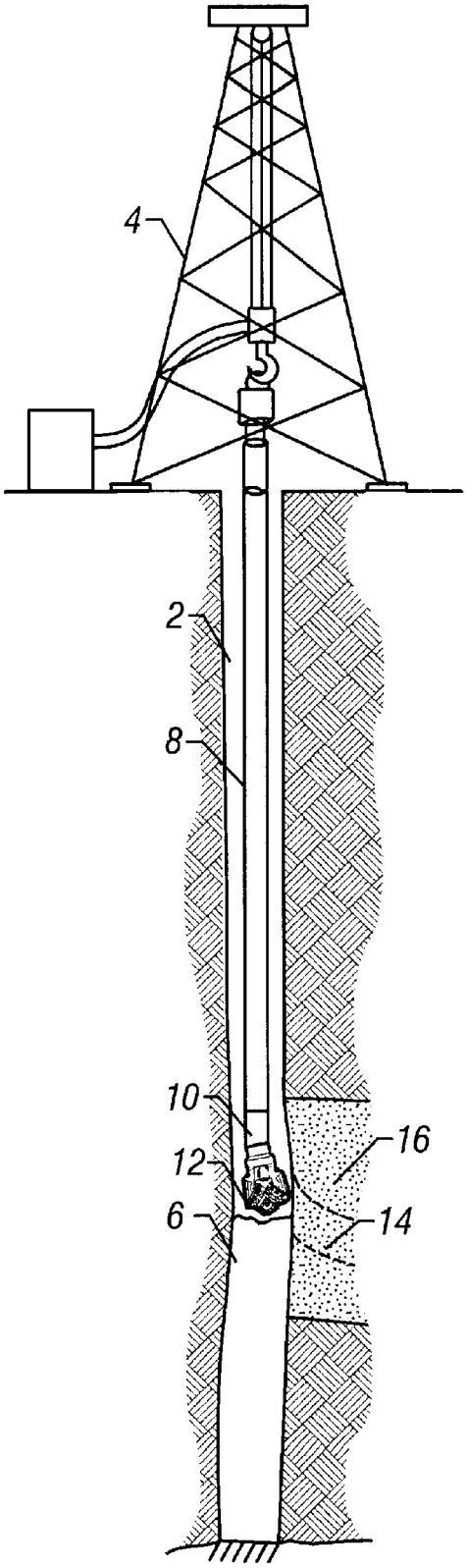
FIG. 1 (Prior Art)
FIG. 1 shows a wellbore which is to be sidetracked in open hole using prior art plug back techniques.

FIG. 1 shows a wellbore 2 drilled through earth formations such as a target formation, shown generally at 16. The wellbore 2 can be drilled using a well known device such as a rotary drilling rig 4, which lowers and retracts segmented drill pipe 8 into the wellbore to turn a drill bit 12 attached to the end of the pipe 8. The rig 4 turns the drill pipe 8, which itself turns the bit 12 to drill the earth formations. It should be clearly understood that the drilling rig 4 as shown in FIG. 1 is only meant to illustrate the general application of this invention. The invention does not require a rotary drilling rig 4 such as shown in FIG. 1, but may also be used with other wellbore drilling apparatus such as coiled tubing (not shown in FIG. 1), electric line and other conveyance mechanisms known in the art.

Techniques known in the art for initiating a sidetrack, the proposed trajectory of which is shown at 14, include filling the lower part of the wellbore 2 with cement, shown generally at 6, waiting for the cement 6 to cure, and then resuming drilling using a steerable or bent housing "mud motor", shown generally at 10 to turn the bit 12. The mud motor 10 (rather than the pipe 8) turns the bit 12 to drill the wellbore 2 along the proposed trajectory 14 of the sidetrack. Techniques well known in the art, such as single/multishot surveys, or measurement-while-drilling can be used to orient the motor 10 to cause the bit 12 to drill along the proposed trajectory 14. As previously explained in the Background section herein, if the cement 6 is relatively soft compared to the target formation 16, or for some reason has non-uniform compressive strength, sometimes the drill bit 12 will preferentially drill the cement 6, making it difficult to start the sidetrack 14 using a steerable or bent-housing motor 10.

Figure 2:
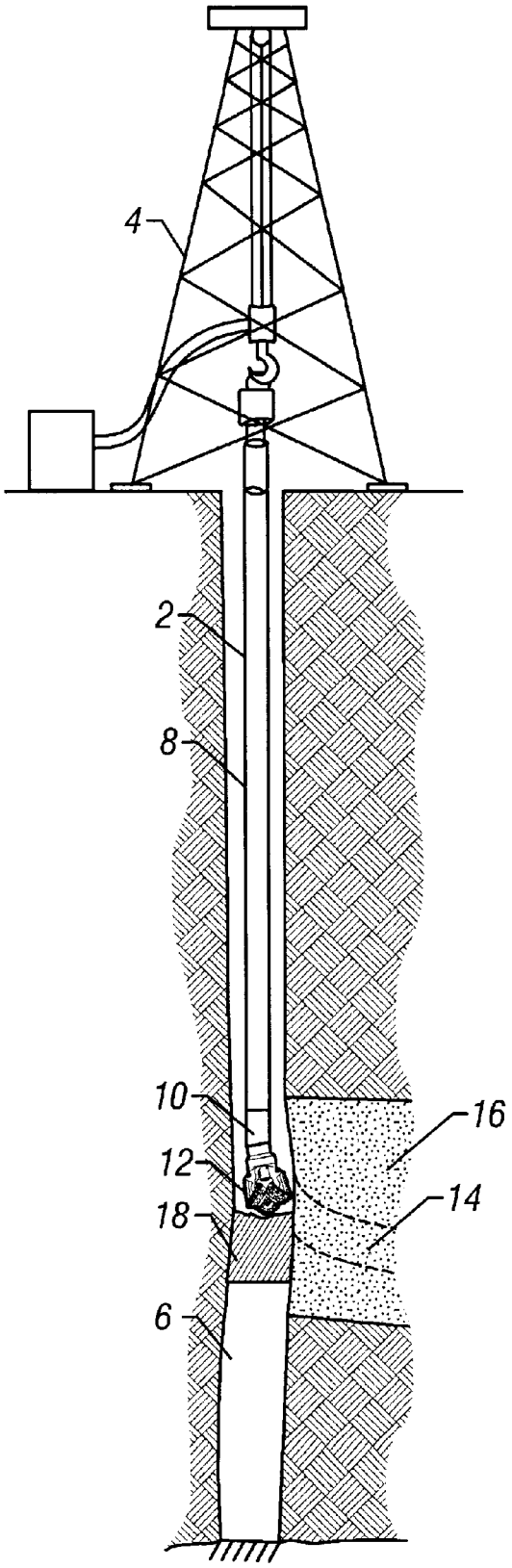
FIG. 2 shows an embodiment the sidetrack plug of this invention as it is used in a wellbore which is to be sidetracked.

In FIG. 2, a sidetrack plug 18 according to one embodiment of the invention is shown positioned at the selected depth in the wellbore 2 at which the sidetrack trajectory 14 is to be started. The lower portion of the original wellbore 2, below the depth of the plug 18, may be filled with cement 6 as in the prior art, but this is not necessary when using the plug 18 of this invention, as will be further explained. The plug 18, when properly set in the wellbore 2 provides a useful thrust surface for the bit 12 to start the sidetrack 14. Importantly, in cases where the target formation 16 is harder (or more "consolidated") than the cement 6, or in cases where the cement 6 has low, or non-uniform compressive strength or has low or non-uniform hardness, the plug 18 can substantially reduce the possibility that the bit 12 will preferentially drill the cement 6 and cause the sidetrack 14 to fail. It is also possible using the plug 18 of this invention to begin drilling the sidetrack 14 almost immediately after setting the plug 18, which eliminates the need to wait for the cement 6 to cure, as in the prior art.

Figure 3:
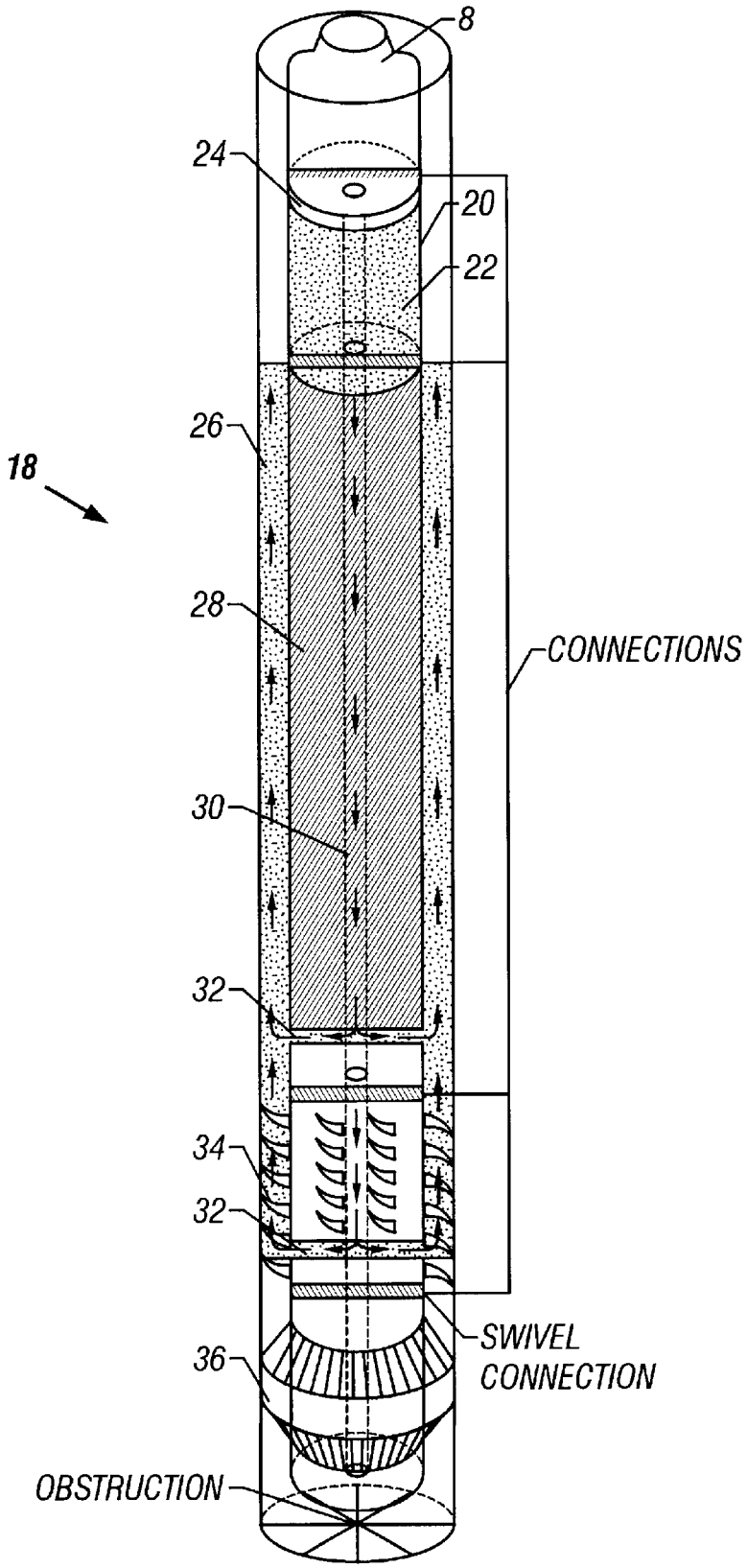
FIG. 3 shows a preferred embodiment of the sidetrack plug of the invention in more detail.

FIG. 3 shows one embodiment of the plug 18 in more detail. Preferably the plug 18 includes an elongated plug body or plug element 28 which can be made from rock such as granite, limestone, marble, dolomite or the like which is somewhat harder than typical earth formations (such as 16 in FIG. 2) through which the wellbore (2 in FIG. 2) is to be drilled. The plug element 28 can have a generally cylindrical shape, but as will be further explained, other shapes may be advantageous. The material for the plug element 28 can be selected from a wide variety of materials, but the material preferably should be approximately as hard or somewhat harder than the target earth formation (16 in FIG. 2) in which the sidetrack (14 in FIG. 2) is to be started, so that the bit (12 in FIG. 2) will not preferentially drill the plug element 28. It is clearly within the contemplation of this invention that non-rock materials, such as a resin-based whipstock material suggested, for example in U.S. Pat. No. 4,182,423 issued to Ziebarth et al could also be used for the plug element 28.

The plug element 28 preferably has an external diameter which enables relatively free movement through the wellbore 2 but minimizes the annular space between the wall of the wellbore 2 and the outside surface of the plug element 28. The axial length of the plug element 28 should be selected so that the sidetrack (14 in FIG. 2) can be completely started without reaching the bottom of the plug element 28. This generally means that by the time the sidetrack 14 extends axially past the bottom of the plug element 28, the bore of the sidetrack 14 should be completely separated from the original wellbore 2. The plug element 28 length required will depend primarily on the angular rate of change of the direction ("build rate") of the sidetrack 14, which as known in the art can range from 1 degree per 100 feet of wellbore length to 100 degrees or more per 100 feet of wellbore length. It is contemplated that the plug element 28 may be assembled from individual segments of the selected plug material each having a standardized length of approximately 30 feet, or any other convenient length. Two or more of the plugs can be used where the build rate is relatively low and would require an extended axial span to fully separate the sidetrack 14 from the original wellbore 2.

The plug element 28 preferably includes a circulation tube 30 extending from one end to the other as shown in FIG. 3 so that as the plug 18 is inserted into the wellbore (2 in FIG. 2) it can move freely through any fluids (typically drilling mud) which may be in the wellbore 2. An anti-axial motion element, shown generally at 36, for preventing axial motion of the plug 18 after it is positioned at the selected depth in the wellbore 2 can be attached to one end of the plug 18, preferably the bottom, but positioning at the top is also acceptable. In one embodiment, the anti-axial motion element 36 can include any well-known inflatable or compression-set bridge plug or the like. When the plug 18 is positioned at the selected depth, the anti-axial motion element 36 can be actuated to prevent any further axial motion of the plug 18. In some cases, such as when the plug 18 is being used to sidetrack abandoned drilling equipment ("fish") for example, the anti-axial motion element 36 may be omitted from the plug 18. The anti-axial motion element 36, when actuated to prevent axial motion of the plug 18 enables compression of a reservoir 20 coupled to the plug element 28. The compression can be provided by well known methods such as exerting downward force on the drill pipe 8 or applying fluid pressure to interior of the drill pipe 8, as will be further explained.

The plug 18 may also include an anti-rotation element, shown generally at 34 attached between the plug element 28 and the anti-axial movement element 36. The anti-rotation element 34 will be further explained, but is intended to help prevent rotation of the plug 18 when the drill bit (12 in FIG. 2) is rotated on top of the plug 18 to start the sidetrack 14, among other reasons. The anti-rotation element 34 can also make it possible to design the plug 18 for quick and easy disengagement from the drill pipe 8 by preventing rotation of the plug 18 in the normal direction of rotation of the drill pipe 8 when turning the bit (12 in FIG. 2) during the time a filler material (which will be further explained) is setting. The drill pipe 8 can be attached to the top of the plug 18 using opposite-hand threads (generally these would be left-hand threads when used with industry standard drill pipe having right-hand threads) whereby normal direction rotation of the drill pipe 8 will disengage the pipe 8 from the plug 18, while the plug 18 is prevented from rotating in that direction in the wellbore 2 by the anti-rotation element 34.

The filler material reservoir 20 can be attached to the top of the plug element 28, or to the bottom thereof. The reservoir 20 carries within it a filler material 22, such as unset cement, epoxy or the like. Generally, the filler material 22 can be any material which can be extruded from the reservoir 20 to fill the annular space between the plug element 28 and the wall of the wellbore 2, while subsequently changing to a substantially non-extrudible state after extrusion into the annular space. The reservoir 20 can be of any type well known in the art, such as elastomeric bellows, or a cylinder which can be compressed by forcing the drill pipe 8 downward onto a piston 24. The reservoir 20 can be in hydraulic communication with vents, such as shown at 32, which exit in an annular space 26 between the plug element 28 and the wall of the wellbore 2. The reservoir 20 can be compressed by means other than downward force on the drill pipe 8 such as dropping a seal ball (not shown) of any type well known in the art to block the circulation tube 30, and then applying fluid pressure to the interior of the drill pipe 8 to cause the piston 24 to move downward. Compression of the reservoir 20 extrudes the filler material 22 through vents 32 into the annular space 26 between the plug element 28 and the wellbore wall. It may be desirable to fix the axial position of the piston 24 using shear pins or the like to enable a selected amount of axial force to be applied to the piston 24 without compressing the reservoir 20, so that the plug 18 can be inserted into the wellbore 2 without unintentionally compressing the reservoir 20. It will generally be necessary to actuate the anti-axial motion element 36 in order to compress the reservoir 20, unless the plug 18 is pushed on top of abandoned drilling apparatus (not shown) or other element in the wellbore 2 so that the plug is prevented from further axial movement down the wellbore 2 when the drill pipe 8 is pushed downwardly.

After the filler material 22 has been discharged into the annular space 26, and the drill pipe has been disengaged from the plug 18, the filler material can be allowed to set so as to bind the plug element 28 within the formation 16. The sidetrack 14 can then be started using a bent housing or steerable motor to turn the drill bit, as previously explained. The filler material 20 can be selected so that it will substantially set during the time the drill pipe 8 is removed from the wellbore 2 to attach the bent housing or steerable motor (10 in FIG. 2). This can eliminate the need to make a separate pipe "trip", or to wait for an extended period of time for cement (the filler material) to set as in the prior art before starting drilling the sidetrack (14 in FIG. 2). The plug element 28 when properly bound within the formation 16 by the filler material 20 provides a useful thrust surface against which the sidetrack (14 in FIG. 2) can be started.

Figure 4:
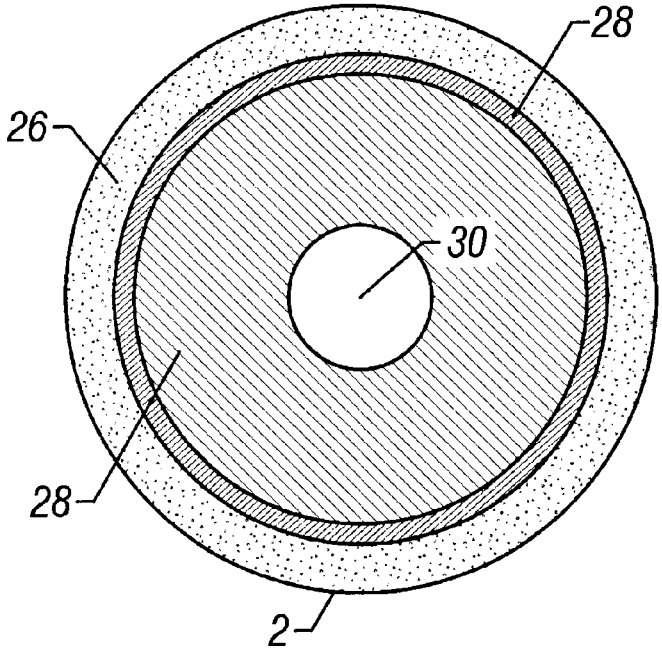
FIG. 4 shows a plug element of the preferred embodiment in cross-section.

A cross-section through the plug body 28 as it is bound in place in the wellbore 2 is shown in FIG. 4. The annular space 26 is shown as filled with the filler material (22 in FIG. 3) to form a substantially continuous thrust surface against which the sidetrack (14 in FIG. 2) can be started.

Figure 5:
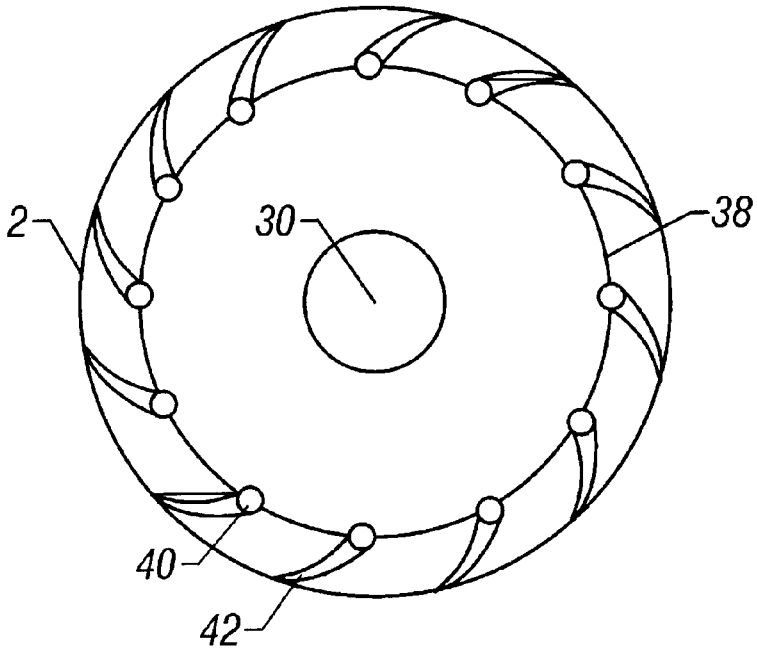
FIG. 5 shows one embodiment of an anti-rotation device to prevent rotation of the plug during initiation of the sidetrack.

One embodiment of the anti-rotation element 34 is shown in cross-section in FIG. 5. A substantially cylindrical housing 38 can be attached to the plug element (28 in FIG. 3) by a threaded connector or the like (not shown). Anti-rotation fingers 42 can be attached each by a hinge 40 to the housing 38. The assembly of housing 38 and fingers 42 acts as a sprag which enables the plug (18 in FIG. 2) to be freely inserted into the wellbore (2 in FIG. 2), but substantially prevents rotation in one direction, particularly the normal direction of rotation of the drill bit. By drilling industry convention the direction of rotation is generally clockwise when looking "downhole" (in a direction towards the bottom of the wellbore), so the hingedly mounted fingers 42 as shown in FIG. 5 are viewed from above in cross-section. As previously explained, by preventing the plug (18 in FIG. 2) from rotating in the normal direction of drill bit rotation, the plug 18 can be easily disengaged from the drill pipe after extruding the filler material (22 in FIG. 3) by normal-direction rotation of the drill pipe (8 in FIG. 3) when it is attached to the top of the plug using opposite-hand threads. Using the anti-rotation element 34 as described here, the well operator can save valuable time by "tripping" the drill pipe (8 in FIG. 3) out of the wellbore 2 immediately after extruding the filler material 22, and "runing in the hole" with a steerable or bent-housing motor, assembly while the filler material 22 cures.

Figure 6:
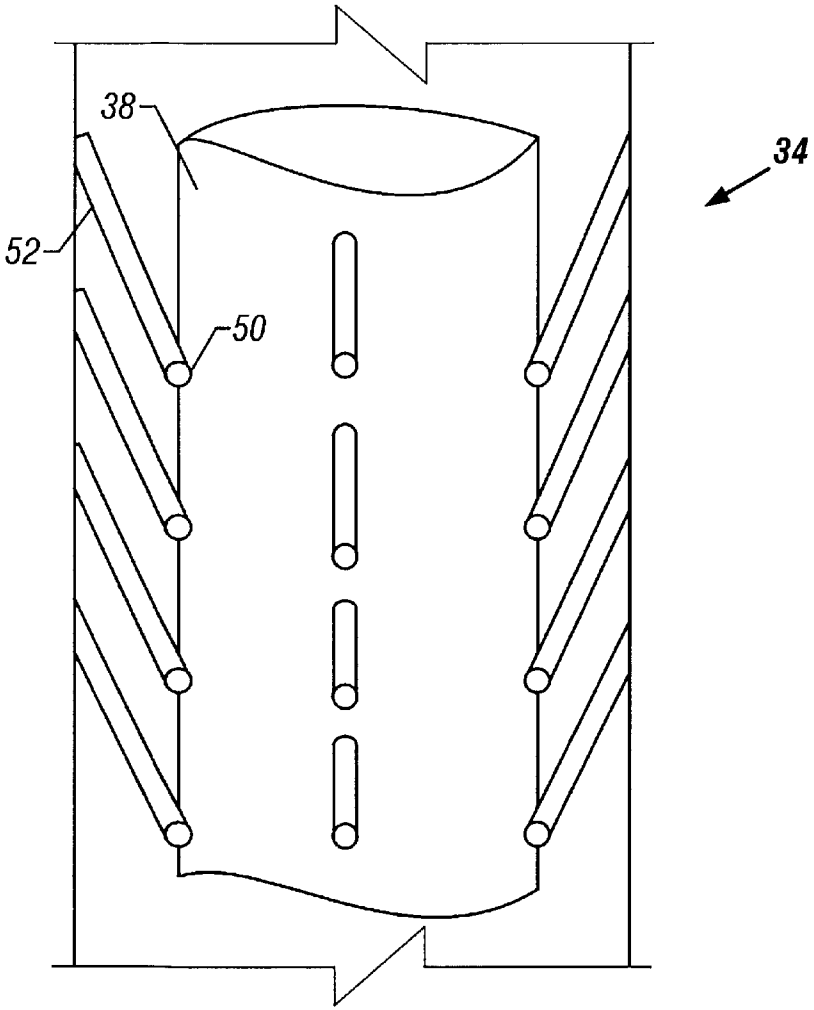
FIG. 6 shows another embodiment of the anti-rotation device.

Another embodiment of the anti-rotation element 34 is shown in FIG. 6. Attached to the housing 38, at axially and circumferentially spaced apart locations, on hinges 50 which enable rotation about the longitudinal axis of the housing, are fingers 52. As the plug (18 in FIG. 2) is inserted into the wellbore (2 in FIG. 2), the fingers 52 will move inward-towards the housing 38 and allow free movement of the plug 18 into the wellbore 2. When the selected depth is reached in the wellbore 2, a slight upward movement of the plug 18 allows the fingers 52 to extend from the housing 38 and lodge into the wall of the wellbore 2. The action of the fingers 52 against the wall of the wellbore prevents both upward axial and rotational movement of the plug 18 in the wellbore 2. Upward force can be maintained on the plug 18 while the reservoir (20 in FIG. 3) is discharged and the filler material (22 in FIG. 2) sets. The combined action of the filler material and the anti-rotation device 34 makes it much less likely that the plug element (28 in FIG. 3) will rotate during initiation of the sidetrack. The embodiments of the anti-rotation element as shown in FIG. 3 and in FIG. 6 are not meant to limit the invention. Other types of anti-rotation elements, such as hydraulically actuated pistons, and other anti-rotation devices can be readily devised by those skilled in the art of wellbore plugging tools.

Figure 7:
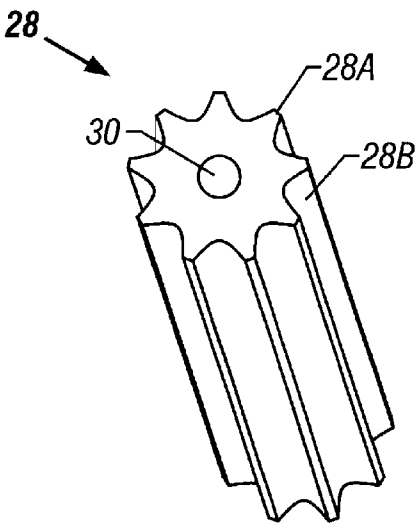
FIG. 7 shows an oblique view of a specific embodiment of the plug element.

Another embodiment of the plug element 28 is shown in FIG. 7. Rather than the generally cylindrical shape as in the embodiment shown in FIG. 3, the plug element 28 shown in FIG. 7 can have circumferentially spaced apart "flutes" as shown generally at 28A, the flutes 28A being separated by channels 28B. The flutes 28A and channels 28B can provide additional binding strength between the plug element 28 and the wellbore wall, particularly by increasing the surface area of the exterior of the plug element 28. The flutes and channels shown in FIG. 7 are not meant to be an exclusive representation of shapes which increase the surface area of the exterior surface of the plug element 28. Other shapes can be readily devised which will also increase the surface area, and/or increase the binding of the plug element 28 in the wellbore 2.

While the foregoing description of the invention is explained in terms of a plug used specifically for sidetracking a wellbore, it is to be clearly understood that the plug of the invention can be used for plugging wellbores where sidetracking thereof is not contemplated.

Those skilled in the art will devise other embodiments of this invention which do not depart from the spirit of the invention as disclosed here. Accordingly, the scope of the invention shall be limited only by the attached claims.

What is claimed is:

1. A plug for a wellbore, comprising:

a plug element adapted to traverse said wellbore; and a compressible reservoir coupled to said plug element, said reservoir hydraulically coupled to an annular space between a wall of said wellbore and an exterior surface of said plug element, said reservoir carrying a filler material therein whereby extrusion of said filler material from said reservoir causes said filler material to fill said annular space so as to bond said plug element to said wall of said wellbore.

2. The plug as defined in claim 1 further comprising an anti-axial motion element coupled to said plug element.

3. The plug as defined in claim 2 wherein said anti-axial motion element comprises an inflatable bridge plug.

4. The plug as defined in claim 1 further comprising an anti-rotation element coupled to said plug element.

5. The plug as defined in claim 4 wherein said anti-rotation element comprises a plurality of fingers each hingedly coupled to a housing, said fingers extending to prevent rotation of said anti-rotation element in one direction but enabling free rotation on the other direction.

6. The plug as defined in claim 4 wherein said anti-rotation element comprises a plurality of fingers each hingedly coupled to a housing, said fingers extending outwardly to prevent upward motion of said plug and preventing rotation of said plug in either rotational direction.

7. The plug as defined in claim 1 wherein said plug element includes a vent tube therethrough to enable free movement of said plug through fluid in said wellbore.

8. The plug as defined in claim 1 wherein said plug element is formed from a rock-like material having a hardness at least approximately as hard as earth formations through which said wellbore is drilled where a sidetrack is to be started.

9. The plug as defined in claim 8 wherein said plug element is formed from limestone.

10. The plug as defined in claim 8 wherein said plug element is formed from granite.

11. The plug as defined in claim 1 wherein said plug element comprises a shape on an exterior surface thereon adapted to increase a surface area of said exterior surface.

12. The plug as defined in claim 1 wherein said filler material comprises cement.

13. The plug as defined in claim 1 wherein said filler material comprises epoxy.

14. The plug as defined in claim 1 wherein said reservoir is compressed by downward force on a top of said reservoir applied by a drill pipe.

15. The plug as defined in claim 1 wherein said reservoir is compressed by application of hydraulic pressure to the interior of a drill pipe.

16. The plug as defined in claim 1 wherein said reservoir comprises a cylinder and a piston.

17. The plug as defined in claim 16 wherein said reservoir is compressed by downward force on a top of said reservoir applied by a drill pipe.

18. The plug as defined in claim 16 wherein said reservoir is compressed by application of hydraulic pressure to the interior of a drill pipe.

19. A method for plugging a wellbore for starting a sidetrack, comprising:

inserting a plug element to a selected depth in said wellbore; and extruding a filler material into an annular space between said plug element and said wellbore by compressing a reservoir coupled to said plug element and in hydraulic communication with said annular space.

20. The method as defined in claim 19 further comprising preventing axial motion of said plug element after positioning at said selected depth by setting an anti-axial motion element coupled to said plug element.

21. The method as defined in claim 20 wherein said anti-axial motion element comprises an inflatable bridge plug.

22. The method as defined in claim 19 further comprising preventing rotation of said plug element by actuating an anti-rotation element coupled to said plug element.

23. The method as defined in claim 22 wherein said anti-rotation element comprises a plurality of fingers each hingedly coupled to a housing, said fingers extending to prevent rotation of said anti-rotation element in one direction but enabling free rotation on the other direction.

24. The method as defined in claim 22 wherein said anti-rotation element comprises a plurality of fingers each hingedly coupled to a housing, said fingers extending outwardly to prevent upward motion of said plug and preventing rotation of said plug in either rotational direction.

25. The method as defined in claim 19 wherein said plug element includes a vent tube therethrough to enable free movement of said plug to said selected depth through fluid in said wellbore.

26. The method as defined in claim 19 wherein said plug element is formed from a rock-like material having a hardness at least approximately as hard as earth formations through which said wellbore is drilled where a sidetrack is to be started.

27. The method as defined in claim 26 wherein said plug element is formed from limestone.

28. The method as defined in claim 26 wherein said plug element is firmed from marble.

29. The method as defined in claim 19 wherein said plug element comprises a shape on an exterior surface thereon adapted to increase a surface area of said exterior surface.

30. The method as defined in claim 19 wherein said filler material comprises cement.

31. The method as defined in claim 19 wherein said filler material comprises epoxy.

32. The method as defined in claim 19 wherein said reservoir is compressed by applying downward force on a top of said reservoir by a drill pipe.

33. The method as defined in claim 19 wherein said reservoir is compressed by applying of hydraulic pressure to the motion of a drill pipe.

34. The method as defined in claim 19 wherein said reservoir comprises a cylinder and a piston.

35. The method as defined in claim 34 wherein said reservoir is compressed by applying downward force on a top of said reservoir by a drill pipe.

36. The method as defined in claim 34 wherein said reservoir is compressed by application of hydraulic pressure to the interior of a drill pipe.

* * * * *